US006755728B2

(12) United States Patent
Sugiura

(10) Patent No.: US 6,755,728 B2
(45) Date of Patent: Jun. 29, 2004

(54) ABRASIVE FILM IN WHICH WATER-SOLUBLE INORGANIC COMPOUND IS ADDED TO BINDER

(75) Inventor: Etsuo Sugiura, Okazaki (JP)

(73) Assignee: Noritake Co., Ltd., Nagoya (JP)

( * ) Notice: Subject to any disclaimer, the term of this patent is extended or adjusted under 35 U.S.C. 154(b) by 0 days.

(21) Appl. No.: 10/105,455

(22) Filed: Mar. 26, 2002

(65) Prior Publication Data

US 2002/0142705 A1 Oct. 3, 2002

(30) Foreign Application Priority Data

Mar. 29, 2001 (JP) ..... 2001-097054
Sep. 17, 2001 (JP) ..... 2001-281577

(51) Int. Cl.[7] ..... B24D 11/00
(52) U.S. Cl. ..... 451/530; 451/539
(58) Field of Search ..... 451/41, 526, 530, 451/533, 539; 51/307, 308

(56) References Cited

U.S. PATENT DOCUMENTS 5,601,474 A * 2/1997 Takahashi ..... 451/28
5,667,426 A * 9/1997 Minami et al. ..... 451/41
5,876,268 A * 3/1999 Lamphere et al. ..... 451/41
5,908,478 A * 6/1999 Wood ..... 51/309
6,113,469 A * 9/2000 Yoshikawa et al. ..... 451/41
6,354,929 B1 * 3/2002 Adefris et al. ..... 451/527
6,443,827 B1 * 9/2002 Ryoke et al. ..... 451/533
2003/0024169 A1 * 2/2003 Kendall et al. ..... 51/297

FOREIGN PATENT DOCUMENTS

| | | |
|---|---|---|
| JP | A-8-333460 | 8/1992 |
| JP | A-9-183055 | 7/1997 |
| JP | B2-2753270 | 5/1998 |
| JP | B2-2934760 | 8/1999 |
| JP | A-2001-9738 | 8/2000 |
| JP | A-2000-354944 | 12/2000 |

* cited by examiner

*Primary Examiner*—Dung Van Nguyen
(74) *Attorney, Agent, or Firm*—Oliff & Berridge, PLC

(57) ABSTRACT

An abrasive film for polishing a workpiece, including: (a) a substrate; (b) a binder; (c) a multiplicity of abrasive grains which are fixed to a surface of the substrate by the binder; and (d) a water-soluble inorganic compound or a water-soluble organic acid alkali metal salt which is added to the binder. The water-soluble inorganic compound preferably consists of a weak-alkali metal salt or a weak-acid metal salt. The water-soluble organic acid alkali metal salt preferably consists of an anionic surface-active agent or a carboxylic acid alkali metal salt.

7 Claims, 2 Drawing Sheets

ABRASIVE FILM IN WHICH WATER-SOLUBLE INORGANIC COMPOUND IS ADDED TO BINDER

BACKGROUND OF THE INVENTION

1. Field of the Invention

The present invention relates in general to an abrasive film, and more particularly to such an abrasive film which is advantageously used to polish a magnetic disk, an end face of an optical fiber or other object or workpiece with high precision.

2. Discussion of the Related Art

There is known an abrasive film which is used to polish a magnetic disk, an end face of an optical fiber or other object or workpiece, with application of a polishing fluid to the abrasive film and/or the workpiece. Such an abrasive film includes (a) a substrate, (b) a binder and (c) a multiplicity of abrasive grains which are fixed to a surface of the substrate by the binder, and is commonly formed to take a roll, sheet or disk shape. In a polishing operation with the abrasive film, the abrasive film and the workpiece are moved relative to each other while being forced to each other, with the application of the polishing fluid, so that the workpiece is polished by the abrasive film. As one example of such an abrasive film, JP-A-2000-354944 (publication of unexamined Japanese Patent Application laid open in 2000) discloses an abrasive film which is used to polish end faces of an optical fiber and a ferrule that is a component of a connector connecting the optical fiber with another optical fiber. In general, the size of the abrasive grains of the abrasive film is reduced with an increase in a required degree of surface smoothness of the workpiece to be polished. For polishing the end face of the ferrule which is commonly required to have a so-called "mirror-finished surface", for example, fine grains having an average size of not larger than 10 $\mu$m are used as the abrasive grains of the abrasive films.

However, the applied polishing fluid is more likely to be repelled by a polishing surface of the abrasive film, as a degree of surface smoothness of the polishing surface is increased as a result of the reduction in the size of the abrasive grains. This means that the applied polishing fluid is less likely to be held between the polishing surface of the abrasive film and a surface of the workpiece that is to be polished during the polishing operation, whereby a frictional heat generating between the abrasive film and the workpiece is undesirably increased, thereby causing the resin binder to be fused and stuck onto the surface of the workpiece, causing the polishing surface to be glazed and/or causing the surface of the workpiece to be burnt. The sticking of the fused binder on the surface of the workpiece inevitably reduces the polishing performance, leading to a problematic reduction in a reliability of the polished workpiece as a product. For example, if the end face of the ferrule is polished in such a condition of the reduced polishing performance, there will be caused a considerable loss in an optical transmission between the optical fibers through the connector which is provided by the polished ferrule.

It might be possible to form pits and projections in the polishing surface of the abrasive film, for example, by roughening a surface of the substrate of the abrasive film, in the interest of facilitating the polishing fluid to be held between the abrasive film and the workpiece during the polishing operation. However, the roughened surface of the substrate is smoothed as the abrasive film is repeatedly used for the polishing operation. The polishing fluid can not be sufficiently held between the abrasive film and the workpiece, once the surface of the substrate of the abrasive film is smoothed. That is, the formation of the pits and projections in the polishing surface of the abrasive film does not provide a fundamental solution to the above-described problem.

SUMMARY OF THE INVENTION

It is therefore a first object of the present invention to provide an abrasive film which includes fine abrasive grains and which is capable of reliably exhibiting an excellent polishing performance without causing a binder to be fused to be stuck onto a polished surface of a workpiece and without causing the polished surface of the workpiece to be burnt, owing to provision for facilitating a polishing fluid to be held between the abrasive film and the polished workpiece in spite of the fineness of the abrasive grains. It is a second object to the invention to provide a polishing method by using the abrasive film having the above technical advantage. The first object may be achieved according to any one of first through tenth aspects of the invention which are described below. The second object may be achieved according to any one of eleventh through fourteenth aspects of the invention which are also described below.

The first aspect of this invention provides an abrasive film for grinding or polishing an object or workpiece, comprising: (a) a substrate; (b) a binder; (c) a multiplicity of abrasive grains which are fixed to a surface of the substrate by the binder; and (d) a water-soluble inorganic compound which is added to the binder.

According to the second aspect of the invention, in the abrasive film defined in the first aspect of the invention, the abrasive grains have an average size of not smaller than 0.01 $\mu$m and not larger than 10 $\mu$m.

According to the third aspect of the invention, in the abrasive film defined in the first or second aspect of the invention, the water-soluble inorganic compound is added in an amount of 1–15 parts by weight per 100 parts by weight of the binder.

According to the fourth aspect of the invention, in the abrasive film defined in any one of the first through third aspects of the invention, the water-soluble inorganic compound consists of a weak-alkali metal salt which is formed of a combination of an alkali metal and a weak acid.

According to the fifth aspect of the invention, in the abrasive film defined in any one of the first through third aspects of the invention, the water-soluble inorganic compound consists of a weak-acid metal salt which is formed of a combination of a metal and a strong acid.

The sixth aspect of the invention provides an abrasive film for grinding or polishing an object or workpiece, comprising: (a) a substrate; (b) a binder; (c) a multiplicity of abrasive grains which are fixed to a surface of the substrate by the binder; and (d) a water-soluble organic acid alkali metal salt which is added to the binder; wherein the water-soluble organic acid alkali metal salt is a solid at an ordinary temperature.

According to the seventh aspect of the invention, in the abrasive film defined in the sixth aspect of the invention, the abrasive grains have an average size of not smaller than 0.05 $\mu$m and not larger than 10 $\mu$m.

According to the eighth aspect of the invention, in the abrasive film defined in the sixth or seventh aspect of the invention, the water-soluble organic acid alkali metal salt is added in an amount of 1–10 parts by weight per 100 parts by weight of the binder.

According to the ninth aspect of the invention, in the abrasive film defined in any one of the sixth through eighth aspects of the invention, the water-soluble organic acid alkali metal salt consists of an anionic surface-active agent.

According to the tenth aspect of the invention, in the abrasive film defined in any one of the sixth through eighth aspects of the invention, the water-soluble organic acid alkali metal salt consists of a carboxylic acid alkali metal salt.

The eleventh aspect of this invention provides a method of grinding or polishing an object or workpiece, by using the abrasive film defined in any one of the first through fifth aspects of the invention. The method comprises steps of moving the workpiece and the abrasive film relative to each other, while forcing the workpiece and the abrasive film against each other; and applying a polishing fluid or liquid including a water, to at least one of the workpiece and the abrasive film.

According to the twelfth aspect of the invention, in the method defined in the eleventh aspect of the invention, the abrasive grains have an average size of not smaller than 0.05 $\mu$m and not larger than 10 $\mu$m.

The thirteenth aspect of this invention provides a method of grinding or polishing an object or workpiece, by using the abrasive film defined in any one of the sixth through tenth aspects of the invention. The method comprises steps of moving the workpiece and the abrasive film relative to each other, while forcing the workpiece and the abrasive film against each other; and applying a polishing fluid or liquid including a water, to at least one of the workpiece and the abrasive film.

According to the fourteenth aspect of the invention, in the method defined in the thirteenth aspect of the invention, the abrasive grains have an average size of not smaller than 0.05 $\mu$m and not larger than 10 $\mu$m.

In a wet polishing operation with the abrasive film defined in the first aspect of the invention, the water-soluble inorganic compound contained in the binder is dissolved into a water component of the polishing fluid, so that a degree of wettability of a polishing surface of the abrasive film with respect to the polishing fluid is increased whereby a sufficient amount of the polishing fluid is held between the abrasive film and the workpiece. The presence of the sufficient amount of the polishing fluid between the abrasive film and the workpiece makes it possible to minimize a temperature rise due to a frictional heat and to accordingly prevent fusion of the binder, glazing of the polishing surface and burning of the polished surface of the workpiece, thereby advantageously assuring an excellent polishing performance with a high stability.

As described above in the BACKGROUND OF THE INVENTION, the applied polishing fluid is less likely to be held between the abrasive film and the workpiece, particularly, where the average size of the abrasive grains is so small as in the abrasive film defined in the second aspect of the invention. However, also in a wet polishing operation with the abrasive film defined in the second aspect of the invention, a sufficient amount of the polishing fluid is held between the abrasive film and the workpiece, owing to the water-soluble inorganic compound contained in the binder, whereby the fusion of the binder, the glazing of the polishing surface and the burning of the polished surface of the workpiece are prevented.

In the abrasive film defined in the third aspect of the invention in which the water-soluble inorganic compound is added in the amount of 1–15 parts by weight per 100 parts by weight of the binder, a sufficient amount of the polishing fluid is held between the abrasive film and the workpiece, and the fusion of the binder is accordingly prevented, without deteriorating the function of the binder, i.e., the function of holding the abrasive grains.

In the abrasive film defined in the fourth aspect of the invention, the water-soluble inorganic compound consists of the weak-alkali metal salt which is formed of the combination of an alkali metal and a weak acid. In the abrasive film defined in the fifth aspect of the invention, the water-soluble inorganic compound consists of the weak-acid metal salt which is formed of the combination of a metal and a strong acid. In either of the abrasive films defined in the respective fourth and fifth aspects-of the invention, the water-soluble inorganic compound contained in the binder is dissolved into the water component of the polishing fluid, so that the degree of wettability of the polishing surface of the abrasive film with respect to the polishing fluid is increased whereby a sufficient amount of the polishing fluid is held between the abrasive film and the workpiece.

The principle of the invention is advantageously applied to, particularly, an abrasive film which includes abrasive grains whose average size is not larger than 10 $\mu$m, or not larger than 5 $\mu$m, or not larger than 3 $\mu$m, and which is used for polishing a magnetic disk or an end face of an optical fiber ferrule in a wet polishing operation with high precision. The ferrule consists of a tubular cylindrical sleeve which is formed of, for example, zirconium oxide or ceramics and which accommodates an optical fiber fixed in a hole of the sleeve. The ferrule is mirror-finished by the abrasive film such that a distal end face of the ferrule is provided by a smoothed, brightened, semi-spherical face. The polishing fluid may consist only of a water, or alternatively, may include a liquid component other than the water and also a solid component such as abrasive particles. It should be noted that the invention may be applied also to an abrasive film which includes abrasive grains whose average size is larger than 10 $\mu$m, and to an abrasive film which is used for polishing workpieces other than the magnetic disk and the optical fiber ferrule.

The abrasive grains of the abrasive film are preferably provided by diamond abrasive grains, but may be provided by also silicon carbide abrasive grains, alumina abrasive grains or other known abrasive grains. The binder of the abrasive film is preferably provided by a resin binder which is formed of modified vinyl chloride resin or other resin having a high degree of water resistance. An abrasive structure or layer in which the abrasive grains are held together by the binder has a thickness which may be determined depending upon, for example, the size of the abrasive grains.

The substrate of the abrasive film is preferably provided by a thin plate, sheet or film which is formed of polyethylene terephthalate or other resin material which has a predetermined degree of mechanical strength and high degrees of water resistance and oil resistance.

If the amount in which the inorganic compound is added to the binder is smaller than 1 part by weight per 100 parts by weight of the binder, the polishing fluid would not be held necessarily in a sufficient amount between the abrasive film and the workpiece that is to be polished. If the amount in which the inorganic compound is added to the binder is larger than 15 parts by weight per 100 parts by weight of the binder, on the other hand, the function of the binder might be reduced due to possible reduction in holding strength with which the binder holds the abrasive grains, or due to possible deterioration of the binder as a result of deliquescence of the inorganic compound. Therefore, the amount in which the inorganic compound is added to the binder is preferably 1–15 parts, more preferably 3–10 parts by weight per 100 parts by weight of the binder, and is suitably determined depending upon the kind of added inorganic compound and the material of the binder such that the amount is held within the preferable range or more preferable range. However, it should be noted that the amount of the inorganic compound does not have to be necessarily held within the preferable range or more preferable range. That is, there are cases where it is possible to achieve the above-described object of the invention even if the amount of the inorganic compound is not held within the preferable range. It is also noted that other additives such as pigment, dispersing agent and antistatic agent may be also added as needed to the binder.

The inorganic compound may be a substance which takes the form of particles dispersed substantially evenly over the entirety of the binder, or alternatively may be a substance which is dissolved in the binder. In either of these cases, the content of the added inorganic compound can be measured or confirmed by a metal-ion analyzing device or other measuring device. Where the inorganic compound takes the form of particles in the binder, it is preferable that the size of each particle of the inorganic compound is smaller than the size of each of the abrasive grains, so that pits or recesses are not formed in the polishing surface of the abrasive film even when the inorganic compound is dissolved in the binder. This is because the formation of the pits or recess in the polishing surface of the abrasive film would lead to deterioration in the polishing performance of the abrasive film.

The inorganic compound preferably consists of the weak-alkali metal salt which is formed of a combination of an alkali metal and a weak acid, as in the abrasive film of the fourth aspect of the invention. The alkali metal may be, for example, sodium or potassium. The weak acid may be, for example, phosphoric acid, boric acid, carbonic acid or silicic acid. The weak-alkali metal salt may be, for example, potassium tertiary phosphate, sodium borate or sodium silicate, each of which can be formed of the corresponding combination of the alkali metal and the weak acid.

Alternatively, the inorganic compound preferably consists of the weak-acid metal salt which is formed of a combination of a metal and a strong acid, as in the abrasive film of the fifth aspect of the invention. The metal may be aluminum, copper, silver, nickel, cobalt, iron, silicon, zinc or other stable metallic element. The strong acid may be, for example, hydrochloric acid, sulfuric acid or nitric acid. The weak-acid metallic may be, for example, an inorganic iron compound such as ferrous chloride, ferric chloride, ferric nitrate, ferrous sulfate and ferric sulfate, or alternatively, copper sulfate or copper nitrate, each of which can be formed of the corresponding combination of the metal and the strong acid.

In a wet polishing operation with the abrasive film defined in the sixth aspect of the invention, the water-soluble organic acid alkali metal salt contained in the binder is dissolved into a water component of the polishing fluid, so that a degree of wettability of a polishing surface of the abrasive film with respect to the polishing fluid is increased whereby a sufficient amount of the polishing fluid is held between the abrasive film and the workpiece. The presence of the sufficient amount of the polishing fluid between the abrasive film and the workpiece makes it possible to minimize a temperature rise due to a frictional heat and to accordingly prevent fusion of the binder, glazing of the polishing surface and burning of the polished surface of the workpiece, thereby advantageously assuring an excellent polishing performance with a high stability. Further, the abrasive film defined in the sixth aspect of the invention can be easily formed since the water-soluble organic acid alkali metal salt is a solid at an ordinary temperature. That is, it is possible to brake or crush the organic acid alkali metal salt into small particles, so as to directly add the organic acid alkali metal salt to the binder. If the additives take the form of a liquid rather than a solid, the additives would have to be added to the binder via a medium which is impregnated with the additives.

As described above in the BACKGROUND OF THE INVENTION, the applied polishing fluid is less likely to be held between the abrasive film and the workpiece, particularly, where the average size of the abrasive grains is so small as in the abrasive film defined in the seventh aspect of the invention. However, also in a wet polishing operation with the abrasive film defined in the seventh aspect of the invention, a sufficient amount of the polishing fluid is held between the abrasive film and the workpiece, owing to the water-soluble organic acid alkali metal salt contained in the binder, whereby the fusion of the binder, the glazing of the polishing surface and the burning of the polished surface of the workpiece are prevented.

In the abrasive film defined in the eighth aspect of the invention in which the water-soluble organic acid alkali metal salt is added in the amount of 1–10 parts, preferably 3–5 parts by weight per 100 parts by weight of the binder, a sufficient amount of the polishing fluid is held between the abrasive film and the workpiece, so that the fusion of the binder is accordingly prevented, without deteriorating the function of the binder, i.e., the function of holding the abrasive grains.

The organic acid alkali metal salt preferably consists of an anionic surface-active agent, as in the abrasive film of the ninth aspect of the invention. The anionic surface-active agent may be, for example, fatty acid sodium, alpha olefin sulfonic acid sodium, lauryl sodium sulfate, or sodium stearate. The anionic surface-active agent is easily mixable into the resin binder and is not likely to be separated from the binder once the anionic surface-active agent is mixed into the binder. Further, the anionic surface-active agent has a high stability even at a high temperature, so that the anionic surface-active agent is not likely to chemically react with the binder even where the anionic surface-active agent is heated. Accordingly, in a wet polishing operation with the abrasive film of the ninth aspect of the invention, the anionic surface-active agent contained in the binder is dissolved into a water component of the polishing fluid, so that a degree of wettability of the polishing surface of the abrasive film with respect to the polishing fluid is increased whereby a sufficient amount of the polishing fluid is held between the abrasive film and the workpiece. The presence of the sufficient amount of the polishing fluid between the abrasive film and the workpiece makes it possible to prevent fusion of the binder, glazing of the polishing surface and burning of the polished surface of the workpiece.

Alternatively, the organic acid alkali metal salt preferably consists of a carboxylic acid alkali metal salt, as in the abrasive film of the tenth aspect of the invention. The carboxylic acid alkali metal salt may be, for example, sodium oxalate, sodium acetate, sodium succinate, sodium citrate, polyacrylic acid sodium, sodium benzoate, potassium oxalate, potassium acetate, potassium succinate, potassium citrate, polyacrylic acid potassium, or potassium benzoate. The carboxylic acid alkali metal salt is easily mixable into the resin binder and is not likely to be separated from the binder once the carboxylic acid alkali metal salt is mixed into the binder. Further, the carboxylic acid alkali metal salt has a high stability even at a high temperature, so that the carboxylic acid alkali metal salt is not likely to chemically react with the binder even where the carboxylic acid alkali metal salt is heated. Accordingly, in a wet polishing operation with the abrasive film of the tenth aspect of the invention, the carboxylic acid alkali metal salt contained in the binder is dissolved into a water component of the polishing fluid, so that a degree of wettability of the polishing surface of the abrasive film with respect to the polishing fluid is increased whereby a sufficient amount of the polishing fluid is held between the abrasive film and the workpiece. The presence of the sufficient amount of the polishing fluid between the abrasive film and the workpiece makes it possible to prevent fusion of the binder, glazing of the polishing surface and burning of the polished surface of the workpiece.

BRIEF DESCRIPTION OF THE DRAWINGS

The above and other objects, features, advantages and technical and industrial significance of this invention will be better understood by reading the following detailed description of the presently preferred embodiments of the invention, when considered in connection with the accompanying drawings, in which.

DETAILED DESCRIPION OF THE PREFERRED EMBODIMENT

Figure 1:
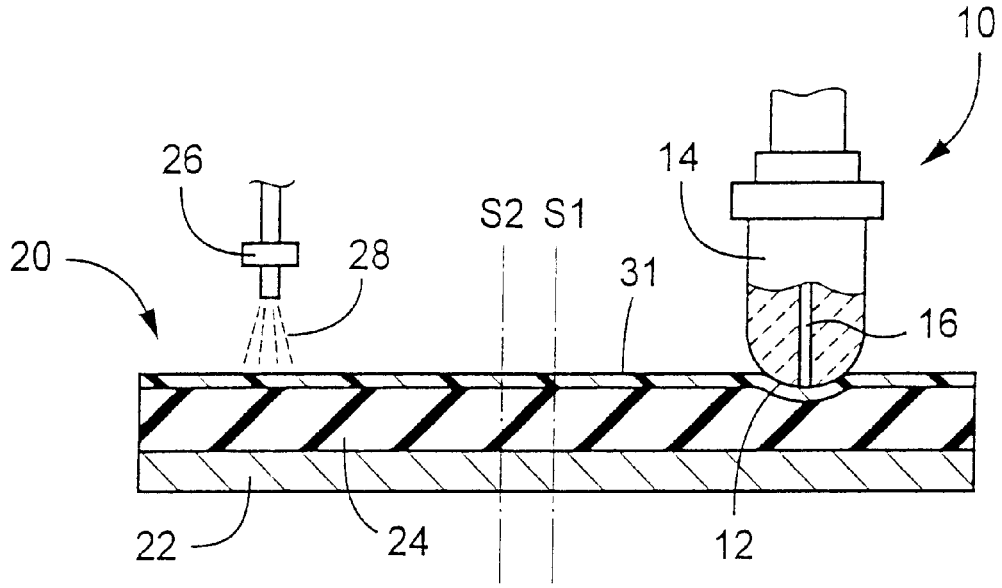
FIG. 1 is a partially cross sectional view showing a wet polishing operation in which a distal end face of a ferrule is polished by an abrasive film constructed according to an embodiment of this invention.

FIG. 1 a partially cross sectional view showing a polishing operation in which a ferrule 10 as a workpiece is polished by an abrasive film 20 constructed according to an embodiment of the invention, with application of a polishing liquid or fluid 28 to the abrasive film 20 and/or the ferrule 10. The ferrule 10 includes a holding sleeve 14 which consists of a tubular cylindrical member formed of a zirconium oxide. The holding sleeve 14 accommodates an optical fiber 16 which is fixed in a hole of the holding sleeve 14. In the polishing operation, a distal end face 12 of the holding sleeve 14 is mirror-polished by the abrasive film 20 such that the distal end face 12 is provided by a smoothed, brightened, semi-spherical convex face. The holding sleeve 14 has an outside diameter of about 2.5 mm and an inside diameter of about 125 $\mu$m. The optical fiber 16 has substantially the same diameter as the inside diameter of the holding sleeve 14 so that the optical fiber 16 is well fitted in the hole of the holding sleeve 14.

The abrasive film 20 has a generally disk shape, and is disposed on a supporting base 22, with a rubber pad 24 being interposed between the abrasive film 20 and the supporting base 22. Prior to the polishing operation, the ferrule 10 is positioned above a polishing surface 31 of the abrasive film 20, and is held perpendicular to the polishing surface 31 of the abrasive film 20 which is held by the supporting base 22 to lie on a horizontal plane. In the polishing operation, the distal end face 12 of the ferrule 10 is forced onto the polishing surface 31 of the abrasive film 20 in the downward direction, such that the rubber pad 24 is elastically deformed whereby the abrasive film 20 is downwardly concaved in a predetermine amount. The abrasive film 20 as well as the supporting base 22 is rotated about a rotation axis $S_1$ which extends substantially in a vertical direction, while being revolved about a revolution axis $S_2$ which is parallel with the rotation axis $S_1$ and which is offset from the rotation axis $S_1$ by a predetermined distance, whereby the abrasive film 20 and the ferrule 10 are moved relative to each other. By the relative movement of the abrasive film 20 and the ferrule 10, the distal end face 12 of the holding sleeve 14 is formed to have a semi-spherical shape. It is noted that the polishing fluid 28 in the from of a water is supplied from a nozzle 26 onto the polishing surface 31 of the abrasive film 20, for cooling and lubricating mutually-contacting portions of the distal end face 12 of the ferrule 10 and the polishing surface 31 of the abrasive film 20.

Figure 2:
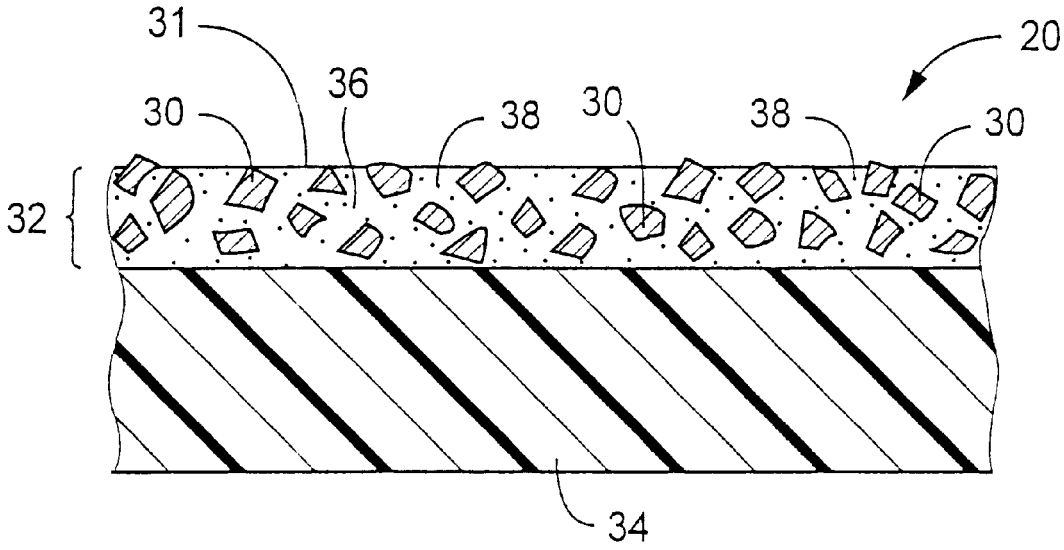
FIG. 2 is a cross sectional view of the abrasive film of FIG. 1.

FIG. 2 is a cross sectional view of the abrasive film 20. As is apparent from FIG. 2, the abrasive film 20 consists of a substrate 34 and an abrasive structure or layer 32 which is disposed on the substrate 34. The abrasive layer 32 includes a multiplicity of fine abrasive grains 30. The substrate 34 consists of a sheet member which has a thickness of about 75 $\mu$m and which is formed of polyethylene terephthalate. The substrate 34 satisfies a required degree of mechanical strength and has high degrees of water resistance and oil resistance. The abrasive layer 32 further includes a binder 36 which serves to hold the abrasive grains 30 together with each other. That is, the abrasive grains 30 are fixed relative to the substrate 34 by the binder 36. The size of each of the abrasive grains 30 may be determined depending upon a required degree of surface smoothness of the workpiece to be polished. In the present embodiment, diamond abrasive grains having an average size of about 0.6 $\mu$m are used as the abrasive grains 30, for carrying out the polishing operation as a final-stage finishing operation. It should be noted that FIGS. 1 and 2 are merely schematic views in which elements are not necessarily accurately illustrated, particularly, in their relative dimensions.

The binder 36 is provided by modified vinyl chloride resin binder having a high degree of water resistance and a high degree of adhesiveness with respect to the substrate 34. Additives 38, each of which consists of an inorganic compound that is soluble in a water, is added to the binder 36 such that the additives 38 are dispersed substantially evenly in the entirety of the binder 36. In the present embodiment, each of the additives 38 consists of sodium silicate which is a weak-alkali metal salt formed of a combination of an alkali metal and a weak acid. The additives 38 are added in an amount of 3–10 parts by weight per 100 parts by weight of the binder 36, namely, per 100 parts by weight of the modified vinyl chloride resin binder.

The abrasive layer 32, having a thickness of about 3 $\mu$m and containing the abrasive grains 30, the binder 36 and the additives 38, is formed on the substrate 34 in the following manner. That is, particles of the sodium silicate each having a smaller size than each abrasive grains 30 are first mixed together with the abrasive grains 30 into the binder 36, so that the sodium silicate particles and the abrasive grains 30 are dispersed in the binder 36. The mixture of the sodium silicate particles, the abrasive grains 30 and the binder 36 is applied substantially evenly over the entirety of a surface of the substrate 34, and is then dried. The dried mixture is subjected to a thermosetting treatment, whereby the abrasive layer 32 is formed on the substrate 34. It is noted that, in addition to the additives 38, other additives such as pigment, dispersing agent and antistatic agent may be added to the binder 36.

In the abrasive film 20 which is constructed as described above, since the particles of the water-soluble sodium silicate as the additives 38 are added in the binder 36, the particles of the sodium silicate are dissolved into the polishing fluid 28, namely, the sodium silicate particles float out of the binder 36, whereby a degree of wettability of the polishing surface 31 of the abrasive film 20 with respect to the polishing fluid 28 is remarkably increased. The increased wettability of the polishing surface 31 of the abrasive film 20 facilitates arrival of a sufficient amount of the polishing fluid 28 at a polishing point at which the distal end face 12 of the ferrule 10 as the workpiece is polished by the polishing surface 31 the abrasive film 20, and the polishing fluid 28 is held between the polishing surface of the abrasive film 20 and the distal end face 12 of the ferrule 10 during the polishing operation. Owing to the presence of the sufficient amount of the polishing fluid 28 between the abrasive film 20 and the polished workpiece, their mutually-contacting portions are sufficiently cooled and lubricated, whereby a temperature rise due to a frictional heat is minimized. Since the binder 36 is prevented from being fused, it is possible to assure an excellent polishing performance with a high stability.

As described above, the abrasive film 20 constructed according to the present embodiment of the invention is advantageously used in a polishing operation in which a water is used as the polishing fluid 28. The distal end face 12 of the ferrule 10, which is being-polished by the abrasive grains 30 whose average size is as small as about 0.6 $\mu$m, is likely to repel the polishing fluid 28. However, the wettability of the abrasive film 20 with respect to the polishing water 28 is increased owing to the presence of the sodium silicate which is added to the binder 36 of the abrasive film 20, so that a sufficient amount of the polishing fluid 28 is held between the distal end face 12 of the ferrule 10 and the polishing surface 31 of the abrasive film 20, whereby fusion of the binder 36 is effectively prevented.

Further, since the amount in which the sodium silicate is added to the binder 36 is held within a range of 3–10 parts by weight per 100 parts by weight of the modified vinyl chloride resin (which is a main component of the binder 36), a sufficient amount of the polishing fluid 28 is held between the abrasive film 20 and the workpiece, and the fusion of the binder 36 is accordingly prevented, without deteriorating the function of the binder 36, i.e., the function of holding the abrasive grains 30.

For confirming the technical advantages provided by the invention, a test was conducted by using two different abrasive films, i.e., the abrasive film 20 of the present invention in which the sodium silicate is added in an amount of 5 parts by weight per 100 parts by weight of the modified vinyl chloride resin, and a conventional abrasive film which is different from the abrasive film 20 in that the binder consists of only the modified vinyl chloride resin. In the test, the distal end face 12 of the ferrule 10 was polished by each of the two abrasive films with application of the polishing fluid 28 to the polishing surface of each abrasive film under the same polishing condition. The conventional abrasive film suffered from fusion of the binder and sticking of the fused binder onto the distal end face 12, consequently providing the distal end face 12 with an unsatisfactory finished surface. On the other hand, the abrasive film 20 did not suffer from fusion of the binder 36, providing the distal end face 12 with a satisfactory finished surface.

While the sodium silicate is used as the additives 38 in the illustrated embodiment, it is also possible to use a water-soluble inorganic compound consisting of iron chloride which is a weak-acid metal salt formed of a metal and a strong acid. A test was conducted by using four abrasive films in each of which iron chloride as the weak-acid metal salt was added in an amount of 1 part, 2 parts, 5 parts or 10 parts by weight per 100 parts by weight of the modified vinyl chloride resin (which is a main component of a binder of the abrasive film). In the test, the distal end face 12 of the ferrule 10 was polished by each of the four abrasive films with application of the polishing fluid 28 to the polishing surface of each abrasive film under the above-described same polishing condition. In the polishing operations with the abrasive film in which the iron chloride is added in an amount of 5 parts by weight and with the abrasive film in which the iron chloride is added in an amount of 10 parts by weight, the distal end face 12 of the ferrule 10 was satisfactorily finished without fusion of their binders. Also in the polishing operations with the abrasive film in which the iron chloride is added in an amount of 1 part by weight and with the abrasive film in which the iron chloride is added in an amount of 2 parts by weight, the distal end face 12 was satisfactorily finished although a small amount of fused binder was stuck onto the distal end face 12. That is, the fusion of the binder was effectively minimized even where the iron chloride is added in an amount as small as 1 part or 2 part by weight.

Figure 3:
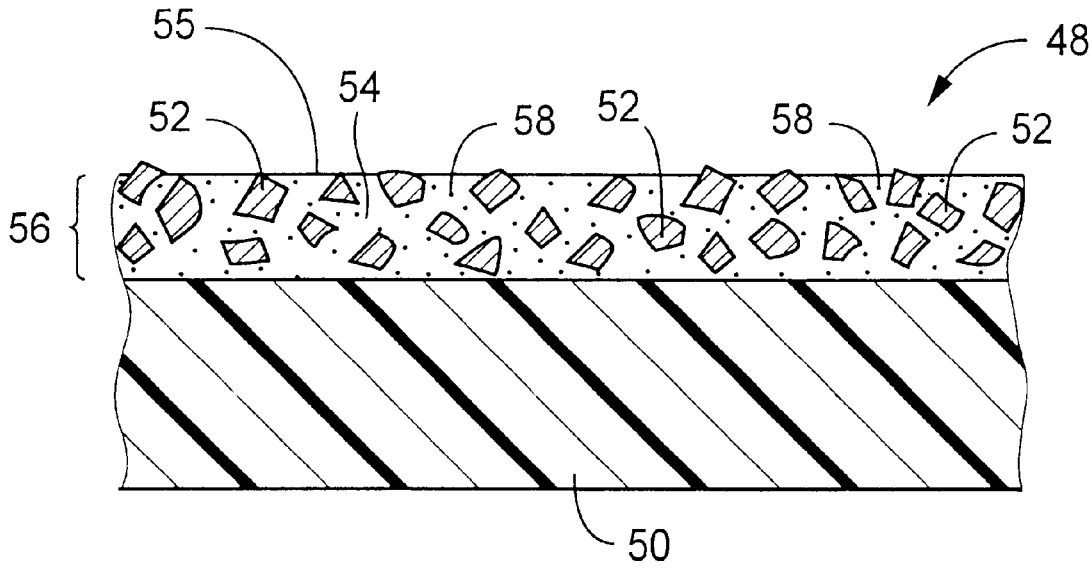
FIG. 3 is a cross sectional view of an abrasive film constructed according to another embodiment of the invention.

FIG. 3 is a cross sectional view of an abrasive film 48 which is constructed according to another embodiment of the invention and which is advantageously used in a wet polishing operation as shown in FIG. 1. As is apparent from FIG. 3, the abrasive film 48 consists of a substrate 50 and an abrasive structure or layer 56 which is disposed on the substrate 50. The abrasive layer 56 includes a multiplicity of fine abrasive grains 52, and a binder 54 which serves to hold the abrasive grains 52 together with each other. Additives 58, each of which consists of an organic acid alkali metal salt, is added to the binder 54 such that the additives 58 are dispersed substantially evenly in the entirety of the binder 54. The additives 58 are soluble in the polishing liquid or fluid 28 that is used in the wet polishing operation.

The abrasive film 48 is produced in the following procedure. That is, firstly, the substrate 50 is provided by a sheet member having a thickness of about 75 $\mu$m and formed of polyethylene terephthalate or other resin material which satisfies a required degree of mechanical strength and has high degrees of water resistance and oil resistance. Secondly, the multiplicity of fine abrasive grains 52 are fixed onto the substrate 50 by the binder 54, whereby the abrasive layer 56, in which the multiplicity of fine abrasive grains 52 are held together with each other by the binder 54, is formed on the substrate 50. The abrasive grains 52 may be provided by super abrasive grains (considerably fine abrasive grains) such as diamond abrasive grains and CBN abrasive grains, or alternatively by standard abrasive grains such as silicon carbide abrasive grains, alumina abrasive grains and ceric oxide. The size of each of the abrasive grains 52 may be determined depending upon a required degree of surface smoothness of the workpiece to be polished. Where the abrasive film is used for polishing an end face of an optical fiber or a magnetic disk with high precision, for example, fine abrasive grains having an average size of 0.05–10 $\mu$m are used as the abrasive grains 52.

The binder 54 is provided by modified vinyl chloride resin binder having a high degree of water resistance and a high degree of adhesiveness with respect to the substrate 50. Each of the additives 58, which consists of the organic acid alkali metal salt, is broken into small particles each having a smaller size that each of the abrasive grains 52. The additives 58, thus broken into the small particles, are mixed together with the abrasive grains 52 into the binder 54, so that the additives 58 and the abrasive grains 52 are dispersed in the binder 54. The mixture of the additives 58, the abrasive grains 52 and the binder 54 is applied substantially evenly over the entirety of a surface of the substrate 50, and is then dried. The dried mixture is subjected to a thermosetting treatment, whereby the abrasive layer 56 is formed on the substrate 50. It is noted that, in addition to the additives 58, other additives such as pigment, dispersing agent and antistatic agent may be added to the binder 54. The additives 58 are added in an amount of 1–10 parts, more preferably 3–5 parts by weight per 100 parts by weight of the binder 54, namely, per 100 parts by weight of the modified vinyl chloride resin binder. If the amount in which the additives 58 are added to the binder 54 is smaller than 1 part by weight per 100 parts by weight of the binder 54, the polishing fluid 28 would not be held necessarily in a sufficient amount between the abrasive film 48 and the workpiece that is to be polished. If the amount in which the additives 58 added to the binder 54 is larger than 10 parts by weight per 100 parts by weight of the binder 54, on the other hand, the function of the binder 54 might be reduced due to possible reduction in holding strength with which the binder 54 holds the abrasive grains 52, or due to possible deterioration of the binder 54 as a result of deliquescence of the additives 58. The reduction in the holding strength of the binder 54 provides a risk of removal of the abrasive grains 52 from the abrasive film 20.

The organic acid alkali metal salt used as the additives 58 may consist of an anionic surface-active agent such as fatty acid sodium, alpha olefin sulfonic acid sodium, lauryl sodium sulfate, and sodium stearate, or alternatively may consist of a carboxylic acid alkali metal salt such as sodium oxalate, sodium acetate, sodium succinate, sodium citrate, polyacrylic acid sodium, sodium benzoate, potassium oxalate, potassium acetate, potassium succinate, potassium citrate, polyacrylic acid potassium, or potassium benzoate. Either of the anionic surface-active agent and the carboxylic acid alkali metal salt is easily mixable into the binder 54 that is formed of the modified vinyl chloride resin, and is not likely to be separated from the binder 54 once the anionic surface-active agent or the carboxylic acid alkali metal salt is mixed into the binder 54. Further, either of the anionic surface-active agent and the carboxylic acid alkali metal salt has a high stability even at a high temperature, so that the anionic surface-active agent or the carboxylic acid alkali metal salt is not likely to chemically react with the binder 54 even where the anionic surface-active agent is heated.

For confirming the technical advantages provided by the invention, a test was conducted by using four different abrasive films, i.e., (a) the abrasive film 48 in which the sodium stearate as the additives 58 is added in an amount of 1 part by weight per 100 parts by weight of the modified vinyl chloride resin, (b) the abrasive film 48 in which the sodium stearate as the additives 58 is added in an amount of 3 parts by weight per 100 parts by weight of the modified vinyl chloride resin, (c) the abrasive film 48 in which the sodium stearate as the additives 58 is added in an amount of 5 parts by weight per 100 parts by weight of the modified vinyl chloride resin, and (d) a conventional abrasive film in which the binder consists of only the modified vinyl chloride resin. In the test, as shown in FIG. 1, the distal end face 12 of the ferrule 10 was polished by each of the four abrasive films with application of the polishing fluid 28 to a polishing surface 55 of each abrasive film under the same polishing condition. The conventional abrasive film suffered from fusion of the binder and sticking of the fused binder onto the distal end face 12, consequently providing the distal end face 12 with an unsatisfactory finished surface. On the other hand, each of the abrasive film 48 in which the sodium stearate is added in the amount of 3 or 5 parts by weight per 100 parts by weight of the modified vinyl chloride resin did not suffer from fusion of the binder 54, providing the distal end face 12 with a satisfactory finished surface. Also in the polishing operation with the abrasive film 48 in which the sodium stearate is added in the amount of 1 part by weight per 100 parts by weight of the modified vinyl chloride resin, the distal end face 12 was satisfactorily finished although a small amount of fused binder was stuck onto the distal end face 12. That is, the fusion of the binder was effectively minimized thereby permitting successive executions of the polishing operation, even where the sodium stearate is added in the amount as small as 1 part by weight per 100 parts by weight of the modified vinyl chloride resin.

As is clear from the result of the conducted test, in a wet polishing operation with the abrasive film 48 constructed according to the embodiment of the invention, the water-soluble organic acid alkali metal salt contained in the binder 54 is dissolved into a water component of the polishing fluid 28, so that a degree of wettability of the polishing surface 55 of the abrasive film 48 with respect to the polishing fluid 28 is increased whereby a sufficient amount of the polishing fluid 28 is held between the abrasive film 48 and the ferrule 10 as the workpiece. The presence of the sufficient amount of the polishing fluid 28 between the abrasive film 48 and the workpiece makes it possible to minimize a temperature rise due to a frictional heat and to accordingly prevent fusion of the binder 54, glazing of the polishing surface 55 and burning of the polished surface of the workpiece, thereby advantageously assuring an excellent polishing performance with a high stability. Further, the abrasive film 48 can be easily formed since the water-soluble organic acid alkali metal salt is a solid at an ordinary temperature. That is, it is possible to brake or crush the organic acid alkali metal salt into small particles, so as to directly add the organic acid alkali metal salt to the binder. If the additives take the form of a liquid rather than a solid, the additives would have to be added to the binder 54 via a medium which is impregnated with the additives.

Like the abrasive film 20 of the above-described embodiment of the invention, the abrasive film 48 of this embodiment of the invention is advantageously used in a wet polishing operation in which the polishing fluid 28 including a water is used. In general, the applied polishing fluid 28 is less likely to be held between the abrasive film and the workpiece, where the average size of the abrasive grains is as small as that of the abrasive grains 52 of the abrasive film 48. However, in the wet polishing operation with the abrasive film 48, a sufficient amount of the polishing fluid 28 is held between the abrasive film 48 and the ferrule 10, owing to the water-soluble organic acid alkali metal salt contained in the binder 54, whereby the fusion of the binder 54, the glazing of the polishing surface 55 and the burning of the polished surface of the ferrule 10 are prevented.

In the abrasive film 48 of this embodiment of the invention in which the water-soluble organic acid alkali metal salt is added in the amount of 1–10 parts, more preferably 3–5 parts by weight per 100 parts by weight of the binder 54, a sufficient amount of the polishing fluid 28 is held between the abrasive film 48 and the workpiece, so that the fusion of the binder 54 is accordingly prevented, without deteriorating the function of the binder 54, i.e., the function of holding the abrasive grains 52.

The organic acid alkali metal salt preferably consists of the anionic surface-active agent which may be, for example, fatty acid sodium, alpha olefin sulfonic acid sodium, lauryl sodium sulfate, or sodium stearate. The anionic surface-active agent is easily mixable into the resin binder 54 and is not likely to be separated from the binder 54 once the anionic surface-active agent is mixed into the binder 54. Further, the anionic surface-active agent has a high stability even at a high temperature, so that the anionic surface-active agent is not likely to chemically react with the binder 54 even where the anionic surface-active agent is heated. Accordingly, in a wet polishing operation with the abrasive film 48, the anionic surface-active agent contained in the binder 54 is dissolved into a water component of the polishing fluid 28, so that a degree of wettability of the polishing surface 55 of the abrasive film 48 with respect to the polishing fluid 28 is increased whereby a sufficient amount of the polishing fluid 28 is held between the abrasive film 48 and the workpiece. The presence of the sufficient amount of the polishing fluid 28 between the abrasive film 48 and the workpiece makes it possible to prevent fusion of the binder 54, glazing of the polishing surface 55 and burning of the polished surface of the workpiece.

Alternatively, the organic acid alkali metal salt preferably consists of the carboxylic acid alkali metal salt which may be, for example, sodium oxalate, sodium acetate, sodium succinate, sodium citrate, polyacrylic acid sodium, sodium benzoate, potassium oxalate, potassium acetate, potassium succinate, potassium citrate, polyacrylic acid potassium, or potassium benzoate. The carboxylic acid alkali metal salt is easily mixable into the resin binder 54 and is not likely to be separated from the binder 54 once the carboxylic acid alkali metal salt is mixed into the binder 54. Further, the carboxylic acid alkali metal salt has a high stability even at a high temperature, so that the carboxylic acid alkali metal salt is not likely to chemically react with the binder 54 even where the carboxylic acid alkali metal salt is heated. Accordingly, in a wet polishing operation with the abrasive film 48, the carboxylic acid alkali metal salt contained in the binder 54 is dissolved into a water component of the polishing fluid 28, so that a degree of wettability of the polishing surface 55 of the abrasive film 48 with respect to the polishing fluid 28 is increased whereby a sufficient amount of the polishing fluid 28 is held between the abrasive film 48 and the ferrule 10 as the workpiece. The presence of the sufficient amount of the polishing fluid 28 between the abrasive film 48 and the workpiece makes it possible to prevent fusion of the binder 54, glazing of the polishing surface 55 and burning of the polished surface of the workpiece.

While the presently preferred embodiments of the present invention have been described above with a certain degree of particularity, by reference to the accompanying drawings, it is to be understood that the invention is not limited to the details of the illustrated embodiments, but may be otherwise embodied.

In the above-illustrated embodiments, the abrasive grains 30 or 52 have the average size of not larger than 10 $\mu$m. However, the abrasive grains used in the abrasive film may have an average size of larger than 10 $\mu$m. Further, the abrasive film of the present invention can be used not only for polishing a magnetic disk or an end face of an optical fiber which requires to be polished with high precision, but also for polishing other workpiece which does not require to be polished with extremely high precision.

While the additives 58 consists only of the sodium stearate in the abrasive film 48 shown in FIG. 3, the additives may consist of other organic acid alkali metal salt, or combination of a plurality of kinds organic acid alkali metal salt, as long as such additives does not provide a particular inconvenience in the process of the formation of the abrasive film and in the polishing operation with the abrasive film. Further, the additives may provided by combination of an anionic surface-active agent and a carboxylic acid alkali metal salt.

While the polishing fluid 28 used for the polishing operation with the abrasive film 20 or 48 consists of a water, the polishing fluid may include a liquid component other than the water and also a solid component such as abrasive particle. That is, as long as the polishing fluid includes the water, the water-soluble inorganic compound or organic acid alkali metal salt contained in the binder is dissolved into the water component of the polishing fluid in a wet polishing operation, so that a degree of wettability of the polishing surface of the abrasive film 20 or 48 with respect to the polishing fluid is increased whereby a sufficient amount of the polishing fluid is held between the abrasive film 20 or 48 and the ferrule 10 as the workpiece, thereby making it possible to prevent fusion of the binder, glazing of the polishing surface and burning of the polished surface of the workpiece.

It is to be understood that the invention is not limited to the details of the illustrated embodiment, but may be embodied with various other changes, modifications and improvements, which may occur to those skilled in the art, without departing from the spirit and scope of the invention defined in the following claims.

What is claimed is:

1. An abrasive film for polishing a workpiece, comprising:

a substrate;

a binder;

a multiplicity of abrasive grains which are fixed to a surface of said substrate by said binder; and a water-soluble inorganic compound which is added to said binder, wherein said water-soluble inorganic compound consists of iron chloride.

2. An abrasive film according to claim 1, wherein said abrasive grains have an average size of not larger than 10 $\mu$m.

3. An abrasive film according to claim 1, wherein said water-soluble inorganic compound is added in an amount of 1–15 parts by weight per 100 parts by weight of said binder.

4. A method of polishing a workpiece, by using the abrasive film defined in claim 1, said method comprising steps of moving said workpiece and said abrasive film relative to each other, while forcing said workpiece and said abrasive film against each other; and applying a polishing fluid including a water, to at least one of said workpiece and said abrasive film.

5. A method according to claim 4, wherein said abrasive grains have an average size of not larger than 10 $\mu$m.

6. An abrasive film according to claim 1, wherein said iron chloride consists of ferrous chloride.

7. An abrasive film according to claim 1, wherein said iron chloride consists of ferric chloride.

* * * * *